United States Patent [19]

Rand et al.

[11] Patent Number: 5,050,867

[45] Date of Patent: Sep. 24, 1991

[54] PORTABLE PROTECTIVE CAGE FOR ATHLETIC EQUIPMENT

[75] Inventors: Delbert B. Rand, 12765 SW. Camellia St., Beaverton, Oreg. 97005; Thomas G. Lindahl, Portland, Oreg.

[73] Assignee: Delbert B. Rand, Beaverton, Oreg.

[21] Appl. No.: 383,870

[22] Filed: Jul. 21, 1989

[51] Int. Cl.[5] ..... A63K 3/04

[52] U.S. Cl. ..... 272/101; 272/3; 52/6

[58] Field of Search ..... 119/19, 20, 27, 155; 272/109, 101, 118, 3; 273/26 R, 26 A, 26 D; 52/693, 690, 694; D25/1

[56] References Cited

U.S. PATENT DOCUMENTS

| | | | |
|---|---|---|---|
| 1,799,861 | 5/1928 | Muzzio | 292/281 |
| 4,078,795 | 3/1978 | Porter | 272/3 |
| 4,422,622 | 12/1983 | Broski, Jr. | 119/20 |
| 4,763,606 | 8/1988 | Ondrasik, II | 119/17 |
| 4,802,314 | 2/1989 | Schildge | 52/83 |
| 4,819,582 | 4/1989 | Lichvar | 119/17 |
| 4,829,936 | 6/1989 | Mollhagen | 119/20 |

*Primary Examiner*—Richard J. Apley
*Assistant Examiner*—Jerome Donnelly
*Attorney, Agent, or Firm*—Chernoff, Vilhauer, McClung & Stenzel

[57] ABSTRACT

Portable cage-like protective apparatus for surrounding athletic field equipment such as pad assemblies for high jump and pole vault landing pits, as protection against mischievous damage to such pad assemblies, making it unnecessary to disassemble and move the pad assemblies or other athletic field equipment daily. Vertical wall panels and horizontal top panels of the apparatus have pipe frames covered with fencing wire cloth such as chain link fencing. Removable wheels provide portability when needed, and a movable wall facilitates movement of the protective cage apparatus into and out of a protective position surrounding jump and vault pit pad assemblies. Truss assemblies extending upward above the cage panels provide stiffening and support, while the total weight of the apparatus is kept low. Disassembly of the apparatus for storage in a compact form is facilitated by the use of simple clamps to interconnect panels to one another.

20 Claims, 4 Drawing Sheets

PORTABLE PROTECTIVE CAGE FOR ATHLETIC EQUIPMENT

BACKGROUND OF THE INVENTION

The present invention relates to protection of athletic field equipment against damage, and in particular concerns apparatus for protecting the pads used for high jump and pole vault landing pits so as to reduce wear and tear and prevent unauthorized use and vandalism.

With wood shavings and sawdust as padding for landing pits for high jumping and pole vaulting competition now being a thing of the past, track teams usually make use of costly multi-section foam rubber pit pad assemblies including complex fitted fabric covers. Such an investment must be protected. In the past, such pit pads have been disassembled and stored in protected areas after each practice session. The pads must then be moved back to and assembled in their proper positions in the high jump and pole vault landing pits at the beginning of the next practice or competition. Such pit pads are large and bulky, in order to absorb the kinetic energy of a falling jumper or pole vaulter without causing injury. In the case of pole vault pits, the pads may be as large as 19'9"×10'×21", in order to provide padding over the entire area of the ground where a pole vaulter might land, either after successful completion of a vault or in case an attempted vault fails.

A typical pit pad assembly includes eight separate pad sections which have to be strapped together securely for safe use. The process of setting up or disassembling and storing such a pit pad assembly typically takes four or five people 20 to 30 minutes to accomplish, so that as much as an hour of time which might be used more profitably in practice work is lost daily.

Not only is a great deal of time and effort expended in moving, assembling, and disassembling such pit pads, but the frequent handling of the sections of a pit pad result in a great deal of wear and tear. Because of such frequent assembly, disassembly, and movement of pit pads, the covers of the separate sections and for the entire assembly, which are the most costly elements of the pit pad assembly, quickly become frayed and must be replaced or repaired annually or even more often.

Such pit pads might be movable as an assembly, but a storage facility would still have to be provided, probably at considerable expense, as well as apparatus suitable for moving the pit pad. Furthermore, at least the uprights and cross bar, if not the entire adjustable base assembly for the uprights, would have to be removed and stored for safety.

While the damage which inevitably results as a consequence of frequent assembly, disassembly, and movement of a jumping pit or vaulting pit pad is significant, leaving such a pit pad assembly in place on a field, without either physical protection or constant supervision, is likely to be much more costly. The presence of such equipment in an accessible location would be an irresistible invitation to many would-be athletes whose lack of the knowledge and skill necessary to perform high jumps or pole vaults would cause a significant risk of serious injury.

Additionally, unprotected equipment of this type is an easy target for vandals or misguided supporters of rival teams, who might tear or cut pit pads or pad covers, making the equipment unusable for a significant amount of time and resulting in expenses of as much as several thousands of dollars for repair or replacement of damaged equipment.

To date there has been no practical and affordable way to provide physical protection of such pit pad assemblies while the pit pads remain in place on an athletic field.

What is needed then, is an economically feasible way to protect athletic field equipment such as, in particular, high jump and pole vault landing pit pads, so that the equipment will not be temptingly available for experimental use by untrained and unsupervised athletes, while keeping the equipment quickly available for use. Additionally, protection should be able to be provided with a minimum of effort upon conclusion of a training session or competition utilizing the equipment.

SUMMARY OF THE INVENTION

The present invention overcomes a major problem associated with the use of costly athletic field equipment such as fabric-covered pad assemblies for high jump and pole vault landing pits, by providing a protective portable cage of lightweight, simple construction, which can disassembled for storage in a relatively small amount of space between athletic seasons, and which can be moved quickly and easily into position daily to protect athletic field equipment which is difficult or time-consuming to move from its useful location to a separate storage location.

In accordance with the present invention a generally rectangular protective cage assembly including sides and a top assembly includes several generally rectangular panels preferably in the form of pipe frames covered with a strong tamper-resistant material such as chain-link fencing wire. The several panels are preferably clamped together securely to facilitate assembly and disassembly of the apparatus, and the panels are preferably light enough for assembly and disassembly of the apparatus to be accomplished readily by two people.

In a preferred embodiment of the invention, one wall panel is mounted on hinges which permit the panel to be raised from a protective vertically-depending position to extend upwardly above the top of the cage, so that the protective cage according to the invention can be moved into place surrounding a high jump or pole vault landing pit pad or other equipment. Thereafter, the wall panel can be lowered and locked into position so that the protective apparatus surrounds and covers the pit pad and provides ample space, between the panels of the protective cage and the pit pad itself, to make it impossible to use the pit pad and difficult to reach the pad to carry out vandalism such as slashing fabric covers with pocket knives or writing graffiti on the pit pad covers.

In a preferred embodiment of the invention a pair of wheels are provided to facilitate movement of the protective cage apparatus. The wheels are mounted so that the cage can be lowered to rest on the ground to prevent entry into the interior of the apparatus, which is too heavy to be lifted readily by a single person, although it is light enough to be moveable easily on its wheels. In one embodiment of the invention the wheels are mounted removably on stub shafts, and a simple jack permits each side of the apparatus to be raised temporarily during removal of or replacement of the wheels.

It is therefore a principal object of the present invention to provide a protective apparatus to make it unnecessary to move athletic field equipment such as a jumping pit pad daily to and from its location for use.

It is another important object of the present invention to provide a protective cage-like apparatus which is easily and quickly movable into and out of a protective position with respect to athletic field equipment to be protected.

It is a further object of the present invention to provide apparatus which will effectively prevent unsupervised use of athletic field equipment in order to prevent injury of unsupervised, unskilled users.

It is yet another object of the present invention to provide such protective apparatus at a reasonable cost.

It is a principal feature of the present invention that it provides a lightweight and portable yet strong cage-like apparatus for covering and surrounding athletic field equipment such as jump and vault landing pit pads.

It is another important feature of the present invention that it provides suitably strong protective apparatus which is easy to assemble or disassemble for storage.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
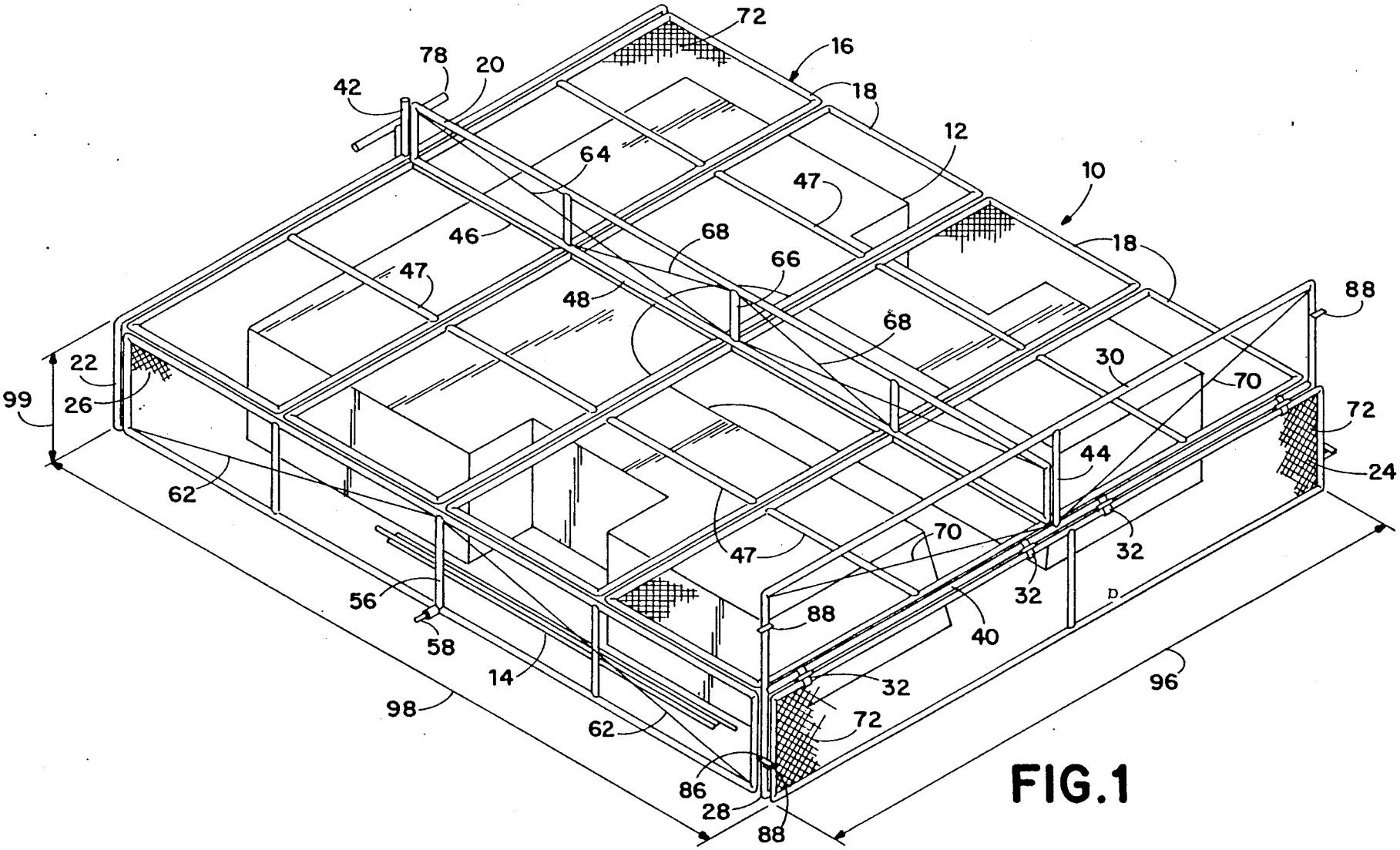
FIG. 1 is an isometric view of a protective cage apparatus according to the present invention protectively covering a pole vault landing pit pad.

Referring to FIGS. 1-4 of the drawings which form a part of the disclosure hereof, a portable pit pad protecting cage 10 embodying the present invention is shown assembled in its operative configuration covering and enclosing a pole vault pit pad assembly 12. A tarpaulin (not shown) might also be used beneath the protective apparatus 10 of the invention to provide additional protection. Also, protectively stored within and beneath the protective cage apparatus 10 of the invention are related pieces of apparatus such as the uprights and cross bar members 14 lying alongside the pole vault pit pad assembly 12.

The protective cage 10 has a top assembly 16 including four interconnected horizontal panels 18, extending transversely and arranged alongside one another, and a substantially vertically upstanding longitudinal truss assembly 20. Four upstanding walls, including a front wall 22, a rear wall 24, and a pair of opposite side walls 26, which are essentially mirror images of one another, support the top assembly 16, forming an enclosure beneath the apparatus 10.

It will be seen that the rear wall 24 is mounted on a support frame 28 including a substantially vertically upstanding transverse truss structure 30 extending above the panels 18 of the top assembly 16. The rear wall 24 is hingedly attached to the rear wall frame 28, as by hinges 32.

The protective cage apparatus 10 is constructed as an interconnected assembly of the panels 18, the truss assembly 20, and the front, rear, and side walls 22, 24, and 26, and the rear wall support frame 28, each panel, wall, and truss assembly being generally of similar panel type construction having a frame of welded pipe. Alternatively, panel frames could be constructed of other suitably strong and durable yet light structural materials such as lightweight metals in suitable shapes or synthetic plastics reinforced by suitable materials such as glass or graphite fibers and provided in tubular or other suitably strong configurations. It is intended by this construction to provide a protective structure which is strong and durable enough to provide the necessary protection, yet which is light enough to be moved daily, if desired, rather than being a massive permanent structure. It is also intended that the protective cage assembly 10 should be able to be disassembled readily enough for storage in a compact form between athletic seasons.

Figure 5:
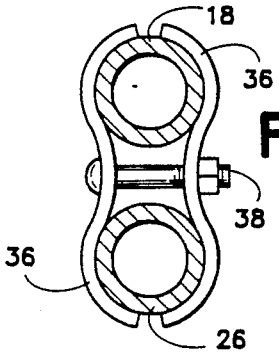
FIG. 5 is a detail view taken along line 5—5 of FIG. 4, showing a clamp device used in assembly of some of the components of the apparatus shown in FIGS. 1-4.

Adjacent portions of the panel frames are secured to one another by removable clamps 34, one of which is shown in end view in FIG. 5. Each of the clamps 34 includes a pair of pipe-gripping plate portions 36 joined together by a bolt 38, to permit assembly and disassembly of the protective apparatus 10 easily by the use of simple hand tools, but not so easily as to invite tampering. Clamps 34 are utilized to interconnect the vertical frame members of the side walls 26 with the vertical frame members of the front wall 22 and the rear wall support frame 28, and to interconnect the adjacent frame members of the top panels 18 with one another and with the horizontal frame members of the front wall 22, side walls 26, and a horizontal frame member 40 of the rear wall support frame 28.

A vertical pipe member 42 extends upward above the front wall 22 as a support for the front end of the longitudinal truss assembly 20, which is attached to the vertical pipe 42 by a clamp 34. Similarly, the rear wall support frame 28 includes a centrally located vertical member 44 extending above the horizontal pipe 40, and a vertical pipe member of the rear end of the longitudinal central truss assembly 20 is attached to the vertical pipe member 28 by another clamp 34.

Figure 2:
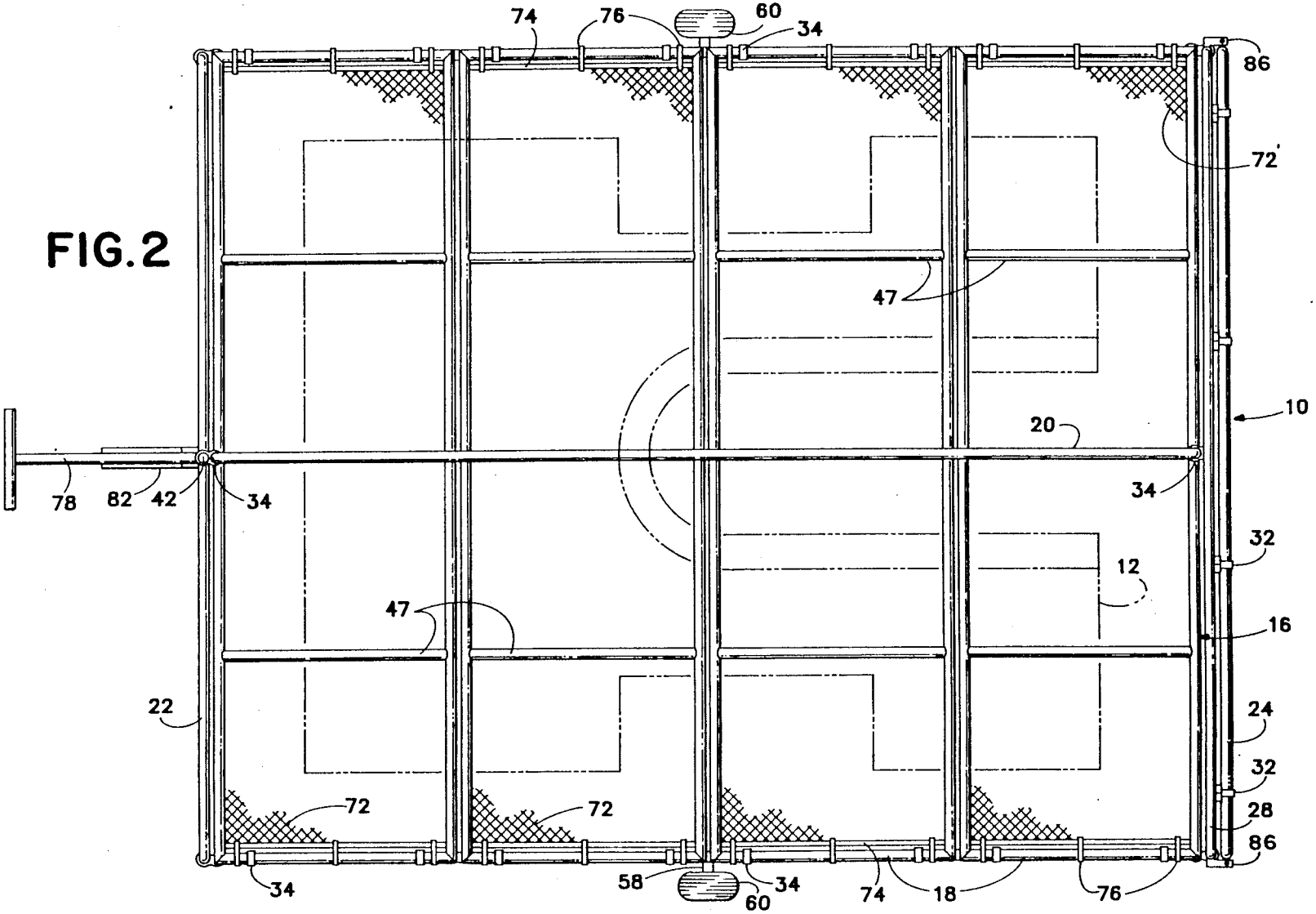
FIG. 2 is a top view of the apparatus shown in FIG. 1.

Each of the panels 18 of the top assembly 16 extends transversely between the side walls 26 and includes a central brace member 46 extending horizontally and longitudinally of the protective cage apparatus 10 directly beneath the bottom of the truss assembly 20. The central brace member 46 of each of the panels 18 is attached to the bottom member 48 of the truss assembly 20, which then provides vertical support for each of the panels 18. Additional brace members 47 may optionally be provided at intermediate locations in each panel 18 as shown in FIGS. 1 and 2.

Figure 6:
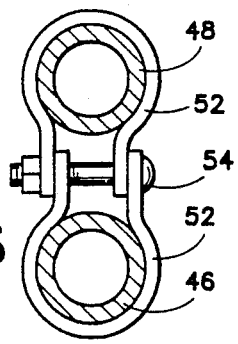
FIG. 6 is a detail view taken along line 6—6 of FIG. 4, showing another clamp device used in assembly of other components of the protective cage apparatus of the invention.
Figure 7:
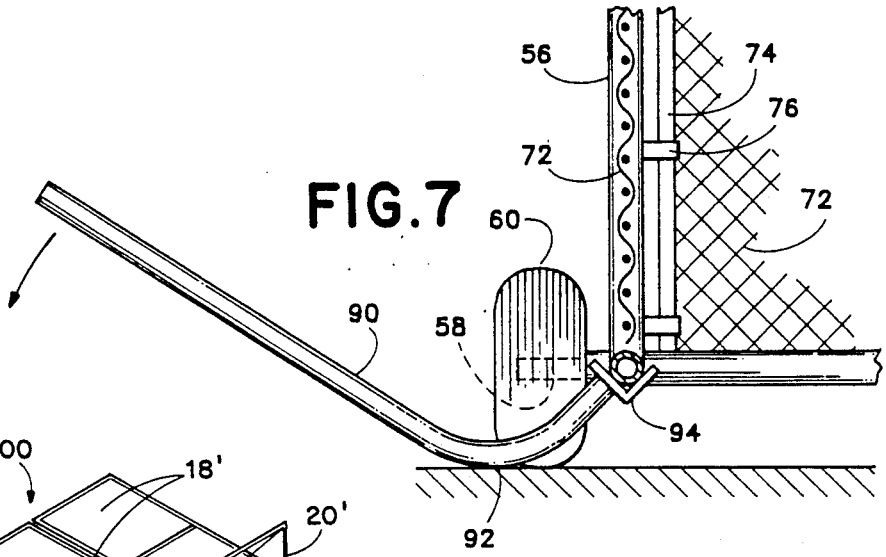
FIGS. 7 and 8 are views of a portion of the apparatus shown in FIGS. 1-4, taken along the line 7—7 of FIG. 4 and showing the use of a jack to raise the protective cage apparatus for removal or replacement of the wheels thereof.

A pair of clamp assemblies 50, one of which is shown in detail in FIG. 6, are used to attach each of the central brace members 46 to the bottom member 48 with somewhat greater ease of assembly than is provided by the clamps 34 used elsewhere. Each clamp assembly 50 includes a strap 52 extending around one of the pipes to be interconnected by the assembly, and a bolt 54 interconnects the interleaved ends of the straps 52, extending through respective bores defined in the straps 52.

Figure 4:
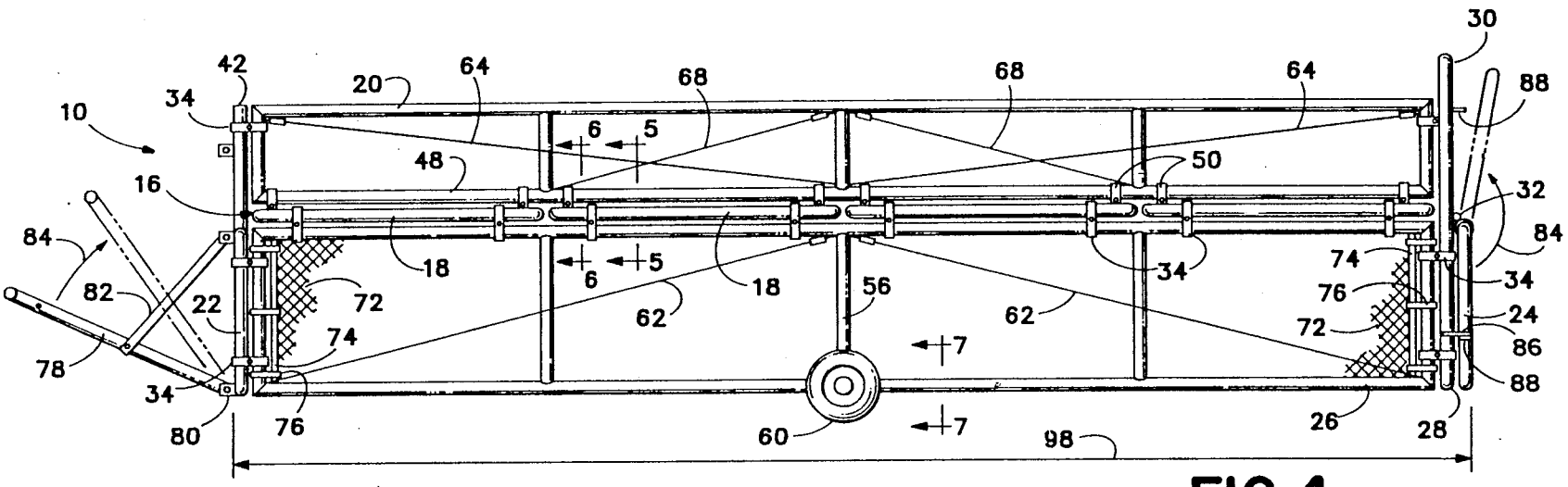
FIG. 4 is a side elevational view of the apparatus shown in FIGS. 1-3.
Figure 3:
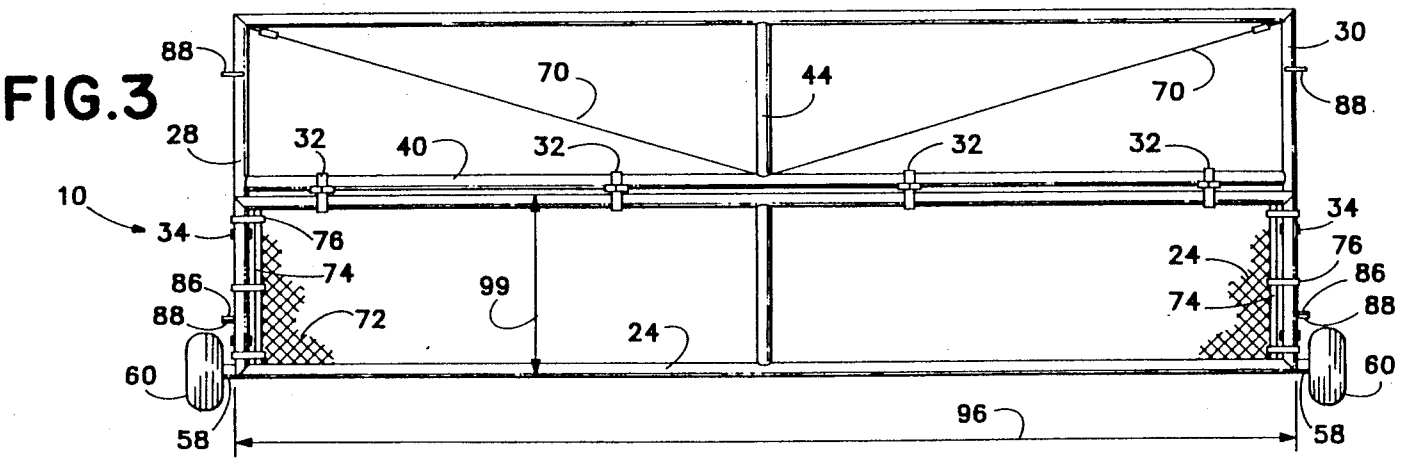
FIG. 3 is a rear elevational view of the apparatus shown in FIGS. 1 and 2.

Each of the side walls 26 includes a centrally located vertical post 56, and a stub axle 58 extends horizontally outward from each side wall 26 at the location of the vertical post 56. A respective removable wheel 60, together with suitable bearings, is mounted upon the stub axle 58 on each of the side walls 26, as shown in FIGS. 2, 3, and 4, when it is desired to move the protective apparatus 10. In order to distribute and support the stresses caused in the side walls 26 by use of the wheels 60 to support the protective cage apparatus 10, diagonal tension members 62 extend downwardly from the upper end of the vertical central post 56 of each side wall 26 to the lower corners of each side wall assembly 26. Preferably, the diagonal tension-bearing members 62 are adjustable by use of threaded fasteners interconnecting the diagonal members with the upper end of the vertical central post 56.

Similarly, diagonal tension-bearing members 64 extend from each upper corner of the longitudinal truss assembly 20 to the middle of the length of the bottom member 48, where there is a vertical pipe member 66. The vertical pipe member 66 extends to the top of the truss assembly 20, and additional diagonal tension members 68 extend downwardly from the top of the vertical member 66 to respective points of attachment centrally located along the bottom member 48 between the vertical member 66 and each end of the truss assembly 20.

Additionally, transverse diagonal tension-bearing members 70, preferably also adjustable by threaded fasteners, extend from the upper corners of the rear wall support frame 28 to the lower end of the vertical pipe member 44 where it is welded to the horizontal member 40, at a laterally central position along the rear wall support frame 28.

Each of the top assembly panels 18, the front wall 22, the rear wall 24, and the side walls 26 is substantially planar and is covered by a strong, durable, tamper-resistant mesh or net covering material 72, such as interlocking coils of heavy wire of the sort known as chain link fencing wire. It is also conceivable that a mesh of a strong and durable plastics material might be suitable. The chain link fencing wire covering 72 is attached to each of the frames of the panels 18 and walls using stretcher bars 74 and clips 76 of conventional design.

A tongue 78 is attached to the frame of the front wall 22 by a suitable bracket 80. The tongue 78 is pivotally connected to the bracket 80 so that it can be held in an operative position, in which it is supported by a brace member 82, also connected pivotally with the front wall 22. Alternatively, the tongue 78 can be moved to in an upright position and pinned in place alongside the vertical pipe 42, as shown in FIG. 1, with the brace member 82 disconnected.

As indicated in FIG. 4, the rear wall 24, mounted pivotally on the hinges 32, may be swung from its normal position shown in solid line in FIG. 4 to an upwardly extending position, as indicated by the arrow 84. Preferably, cooperatively located padeyes 86 and 88 are located on the rear wall 24 and at two locations on each of the vertical end members of the rear wall support frame 28. The rear wall 24 can be secured by the padeyes 86 and 88, either in a raised, open, position or the lowered position shown in FIG. 1, in which the protective cage apparatus 10 forms an enclosure to surround and protect vulnerable athletic field equipment such as the pit pad 12.

The apparatus 10 can be made in the required size for a particular piece of equipment which is to be protected. For example, for use in protecting a landing pit pad assembly for a pole vaulting pit it has been found satisfactory to use a width 96 of 20 feet, a length 98 of about 24 feet, and a height 99 of about 3½ feet for each upstanding wall. In such an embodiment of the invention the longitudinal truss 20 extends about 27 inches above the upstanding walls, and the transverse truss assembly 30 extends about 3½ feet above the upstanding walls. Welded steel galvanized pipe 1⅜ inches in outside diameter is used for the frame structure of each panel. This size of the protective apparatus 10 leaves ample room within the protective cage on all sides of and above the pit pad assembly 12 to diminish the likelihood of damage being done to the equipment and provide space for storage of poles, uprights, and crossbars beneath the apparatus 10.

In use, the protective cage apparatus 10 of the invention is located to surround a piece of athletic field apparatus such as a pole vault pit pad assembly 12, with the wheels 60 removed from the stub axles 58 and the entire protective cage 10 resting on the ground to prevent access to the enclosed equipment. Because a certain amount of space, at least a foot and preferably more, is desirably provided between the panel covering material 72 and the equipment protected by the protective cage apparatus 10, the athletic equipment is not available for experimental use by unsupervised athletes, and access to the equipment by would-be vandals without very serious resolve to commit mischief is made appreciably more difficult. Most important, however, is that the protective apparatus 10 makes it unnecessary to move cumbersome equipment such as the pole vault pit pad assembly 12 into place before each practice session and from the landing pit back to a storage shed or the like after each practice session.

In accordance with the present invention, a simple jack 90, a lever including a curved fulcrum portion 92 which can rest on the ground and a cradle portion 94 which can be inserted beneath the lower horizontal frame member of each side wall 26, is used to raise the protective apparatus, one side at a time, to permit each wheel 60 to be mounted on the respective stub axle 58. Thereafter, with the rear wall 24 locked or pinned in its raised position, clearance is available at the rear end of the apparatus 10 to permit it to be pulled by the tongue 78 from its position covering and protectively enclosing the athletic field equipment. The protective cage apparatus 10 can easily be wheeled to a suitable location where it will not obstruct athletes. After completion of a practice session involving the athletic equipment the protective cage apparatus 10 is simply wheeled back into a position protectively surrounding the equipment. The wheels 60 are then removed from the stub axles, permitting the protective apparatus 10 to be lowered to the ground by the jack 90, and the rear wall 24 is returned to its normal lowered position and locked. Preferably, the cage apparatus 10 is lowered before the rear wall 24 is lowered, permitting the jack 90 and wheels 60 to be stored beneath the protective apparatus before the rear wall 24 is lowered and locked.

Figure 9:
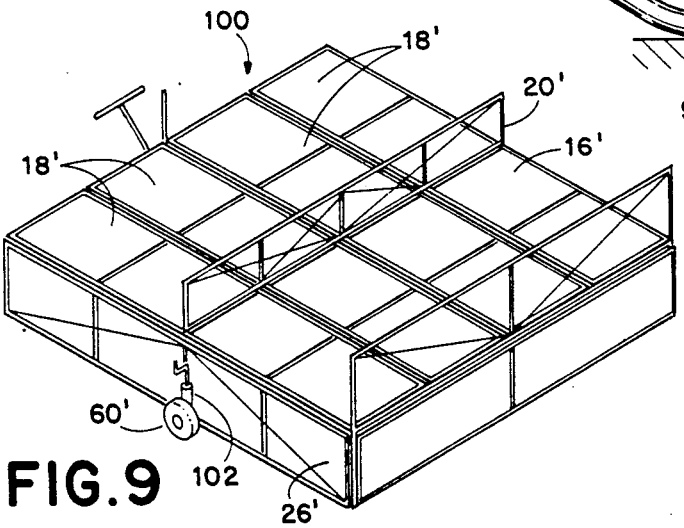
FIG. 9 is a simplified view of an alternative embodiment of the invention.
Figure 8:
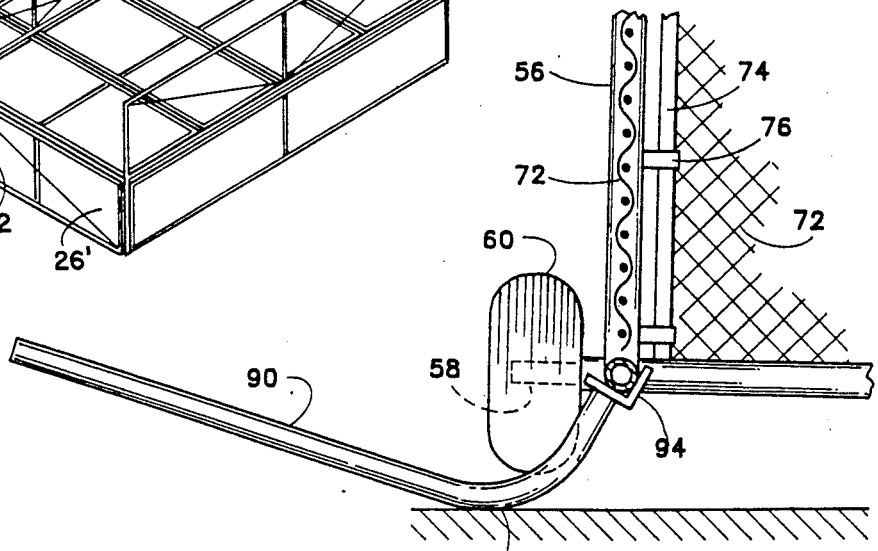

A portable protective cage 100 (FIG. 9) which is an alternative embodiment of the invention is of construction basically similar to the protective apparatus 10, but having a top assembly 16' in which horizontal panels 18' are arranged to extend from front to rear instead of transversely, and an upstanding truss assembly 20' extends transversely between the side walls 26'. A pair of wheels 60' are mounted on stub axles carried on individual jacks 102 mounted on the side walls 26' to permit the cage 100 to be raised for movement or lowered to rest protectively on the ground surrounding equipment to be protected.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. In combination with athletic field equipment including a landing pit pad assembly having a plurality of sides, apparatus for helping to prevent damage to said athletic field equipment, comprising:

(a) a lightweight frame of a size large enough to surround said landing pit pad assembly with at least a predetermined separation from the landing pit pad assembly thereabove and on all sides thereof;

(b) a strong durable covering mounted on said frame, said frame and covering in combination forming a portable protective enclosure including a top assembly and a plurality of upstanding walls for preventing a person from reaching the landing pit pad assembly stored therein; and (c) means associated with a lower portion of said frame for selectively supporting the said frame and said covering to facilitate movement thereof along the ground.

2. In combination with athletic field equipment including a landing pit pad assembly having a plurality of sides, apparatus for helping to prevent damage to said athletic field equipment, comprising:

(a) a lightweight frame of a size large enough to surround said landing pit pad assembly with at least a predetermined separation from the landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein; and (c) wheel means for selectively supporting said frame and said covering to facilitate movement of said apparatus.

3. The apparatus of claim 1 wherein said frame is of pipe and said covering comprises chain link fencing wire.

4. The apparatus of claim 1 wherein said frame is of pipe and said pipe is of fiber-reinforced plastics material.

5. In combination with athletic field equipment including a landing pit pad assembly having a plurality of sides, apparatus for helping to prevent damage to said athletic field equipment, comprising: p1 (a) a lightweight frame of a size large enough to surround said landing pit pad assembly with at least a predetermined separation from the landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein;

(c) means associated with a lower portion of said frame for selectively supporting said frame and said covering for movement thereof along the ground; and (d) at least a portion of one of said upstanding walls being movable to a position providing clearance for movement of said apparatus horizontally between a position in which said apparatus protective surrounds said landing pit pad assembly and a position in which said apparatus is clear of said pit pad assembly.

6. The apparatus of claim 1 wherein said frame includes a plurality of flat rectangular panels each covered individually by a respective portion of said covering, said rectangular panels being interconnected with one another by removable clamps facilitating disassembly of said apparatus for storage in a reduced amount of space.

7. The apparatus of claim 12 wherein said upstanding truss means includes a truss frame of tube construction and diagonal tension-bearing bracing members.

8. In combination with athletic field equipment including a landing pit pad assembly having a plurality of sides, apparatus for helping to prevent damage to said athletic field equipment, comprising:

(a) a lightweight frame of a size large enough to surround said landing pit pad assembly with at least a predetermined separation from the landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein;

(c) a pair of upstanding opposite side walls included in said plurality of upstanding walls; and (d) wheel means for selectively supporting said frame and said covering for movement thereof, said wheel means including a pair of stub axles, each associated with one of said upstanding opposite side walls, and wheels removably located on said stud axles for carrying said apparatus at a suitable height facilitating removal of said apparatus from a protective position with respect to said landing pit pad assembly.

9. The apparatus of claim 1 wherein said top assembly includes a plurality of elongated rectangular horizontal panels joined together side-by-side in a coplanar arrangement and interconnected with respective ones of said upstanding walls.

10. In combination with athletic field equipment including a landing pit pad assembly having a plurality of sides, apparatus for helping to prevent damage to said athletic field equipment, comprising:

(a) a lightweight frame of a size large enough to surround said landing pit pad assembly with at least a predetermined separation from the landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein;

(c) a tongue connected to one of said upstanding walls and movable, selectively, between a stowed position extending upright along said one of said upstanding walls and a transport position in which said tongue extends away from said one of said upstanding walls in position to be held conveniently to control movement of said apparatus to and from a position protectively surrounding said landing pit pad assembly; and (d) means associated with a lower portion of said frame for selectively supporting said frame and said covering for movement thereof along the ground.

11. In combination with athletic field equipment including pit pad assembly having a plurality of sides, apparatus for helping to prevent damage to said athletic field equipment, comprising:

(a) a lightweight frame of a size larger enough to surround said landing pit pad assembly with at least a predetermined separation from the landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein;

(c) means associated with a lower portion of said frame for selectively supporting said frame and said covering for movement thereof along the ground; and (d) said predetermined separation being at least about one foot, between each of said upstanding side walls and said top assembly and a landing pit pad assembly located beneath and within said apparatus.

12. Protective apparatus for helping to prevent damage to athletic field equipment, comprising;

(a) a lightweight frame of a size large enough to surround a landing pit pad assembly with at least a predetermined separation from said landing pit pad assembly thereabove and on all sides thereof;

(b) a strong durable covering mounted on said frame, said frame and covering in combination forming a portable protective enclosure including a top assembly and a plurality of upstanding walls for preventing a person from reaching the landing pit pad assembly stored therein;

(c) upstanding truss means located above said top assembly for providing stiffening support thereto; and (d) means associated with a lower portion of said frame for selectively supporting said frame and said covering to facilitate movement thereof along the ground.

13. Protective apparatus for helping to prevent damage to athletic field equipment, comprising:

(a) a lightweight frame of a size large enough to surround a landing pit pad assembly with at least a predetermined separation from said landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein; and (c) upstanding truss means arranged above one of said upstanding walls, said one of said upstanding walls being selectively movable between a protective first position and a second position providing clearance for movement of said protective apparatus substantially horizontally between a location wherein said protective apparatus encloses said landing pit pad assembly and prevents access thereto and a location spaced apart from said landing pit pad assembly.

14. Protective apparatus for helping to prevent damage to athletic field equipment, comprising:

(a) a lightweight frame defining a pair of opposite ends and being of a size large enough to surround a landing pit pad assembly with at least a predetermined separation from said landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein, said plurality of upstanding walls including a pair of opposite side walls each including a respective pair of diagonal tension-bearing members;

(c) an upstanding longitudinal truss assembly extending above said top assembly; and (d) an upstanding transverse truss assembly extending above said top assembly adjacent one of said opposite ends of said apparatus, one of said upstanding walls being located at said one of said opposite ends and being selectively removable to a position providing clearance for movement of said protective apparatus substantially horizontally, between a location wherein said protective apparatus encloses said landing pit pad assembly and prevents access thereto and a location spaced apart from said landing pit pad assembly, permitting use thereof.

15. Protective apparatus for helping to prevent damage to athletic field equipment, comprising:

(a) a lightweight frame of a size large enough to surround a landing pit pad assembly with at least a predetermined separation from said landing pit pad assembly thereabove and on all sides thereof;

(b) a strong durable covering mounted on said frame, said frame and covering in combination forming a protective enclosure including a top assembly and a plurality of upstanding walls including a pair of opposite side walls, for preventing a person from reaching the landing pit pad assembly stored therein, said top assembly including a plurality of elongate rectangular horizontal panels joined together side-by-side in a coplanar arrangement and interconnected with respective ones of said upstanding walls, each of said rectangular horizontal panels extending transversely of said apparatus over substantially the entire distance between said opposite side walls thereof and each of said rectangular horizontal panels including a central frame member extending generally longitudinally of said apparatus; and (c) a longitudinal truss extending upwardly above said rectangular horizontal panels of said top assembly, said longitudinal truss assembly being interconnected supportively with said central frame member of each of said rectangular horizontal panels of said top assembly.

16. Protective apparatus for helping to prevent damage to athletic field equipment, comprising:

(a) a lightweight frame of a size large enough to surround a landing pit pad assembly with at least a predetermined separation from said landing pit pad assembly thereabove and on all sides thereof; and (b) a strong durable covering mounted on said frame, said frame and covering in combination forming a protective enclosure including a top assembly and a plurality of upstanding walls for preventing a person from reaching the landing pit pad assembly stored therein, said plurality of upstanding walls including a pair of opposite side walls, each of said plurality of upstanding side walls including a frame constructed of pipe and covered by chain link fencing wire, said frame of each of said opposite side walls including a pair of opposite ends, an upstanding central post located intermediate between said opposite ends, a stub axle mounted on said frame and extending outwardly horizontally away from said side wall in a location adjacent said vertical member, and a pair of diagonal tension-bearing members extending between said upstanding central post and said opposite ends of said side wall frame.

17. Protective apparatus for helping to prevent damage to athletic field equipment, comprising:

(a) a lightweight frame of a size large enough to surround a landing pit pad assembly with at least a predetermined separation from said landing pit pad assembly thereabove and on all sides thereof;

(b) a strong durable covering mounted on said frame, said frame and covering in combination forming a protective enclosure including a top assembly and a plurality of upstanding walls for preventing a person from reaching the landing pit pad assembly stored therein, at least a portion of at least one of said upstanding walls being rotatable about a horizontal axis to a position providing clearance beneath said portion for movement of said protective apparatus horizontally between a position in which said protective apparatus protectively surrounds a landing pit pad assembly and a position in which said protective apparatus is clear of said landing pit pad assembly.

18. A method for helping to prevent damage to athletic field equipment such as a landing pit pad assembly, comprising:

(a) providing apparatus including a lightweight frame of a size large enough to surround a landing pit pad assembly having a plurality of sides and a top with at least a predetermined separation between said apparatus and said landing pit pad assembly above said top and on all sides thereof;

(b) providing a strong durable covering mounted on said frame so that said frame and covering in combination form a protective enclosure including a top assembly and a plurality of upstanding walls; and (c) placing said apparatus around said athletic field equipment when the equipment is not in use, leaving at least said predetermined separation between said protective enclosure and each side of said landing pit pad assembly, so as to prevent a person from reaching the landing pit pad assembly stored therein.

19. The method of claim 18 including the step of rotating at least a portion of one of said upstanding walls about a horizontal axis to a position providing clearance beneath said portion, and thereafter moving said apparatus horizontally between a position in which said protective apparatus protectively surrounds a landing pit pad assembly and a position in which said protective apparatus is clear of said landing pit pad assembly.

20. The method of claim 19, including the step of selectively supporting said frame on wheels removably mounted on a pair of stub axles, each associated with one of said upstanding opposite side walls, and thereby carrying said protective apparatus at a suitable height facilitating removal of said protective apparatus from a protective position with respect to a landing pit pad assembly.

* * * * *

UNITED STATES PATENT AND TRADEMARK OFFICE

CERTIFICATE OF CORRECTION

PATENT NO. : 5,050,867

DATED : September 24, 1991

INVENTOR(S) : D. Ben Rand

It is certified that error appears in the above-identified patent and that said Letters Patent is hereby corrected as shown below:

| | | |
|---|---|---|
| Col. 7, | line 62 | Delete --p1-- and create indented paragraph beginning at "(a)". |
| Col. 9, | line 16 | After "including" add --a landing--; |
| | line 19 | Change "larger" to --large--. |

Signed and Sealed this

Ninth Day of March, 1993

*Attest:*

STEPHEN G. KUNIN

*Attesting Officer*

*Acting Commissioner of Patents and Trademarks*